US007264140B1

(12) United States Patent
Stoddard et al.

(10) Patent No.: US 7,264,140 B1
(45) Date of Patent: Sep. 4, 2007

(54) SYSTEM AND METHOD FOR DISPENSING PHARMACEUTICAL SAMPLES

(75) Inventors: John Philip Stoddard, Ben Lomond, CA (US); Michael John Nuttall, Portola Valley, CA (US)

(73) Assignee: Thomas Direct Sales, Inc., Clifton, NJ (US)

( * ) Notice: Subject to any disclaimer, the term of this patent is extended or adjusted under 35 U.S.C. 154(b) by 205 days.

(21) Appl. No.: 11/047,990

(22) Filed: Jan. 31, 2005

Related U.S. Application Data

(63) Continuation-in-part of application No. 29/212,993, filed on Sep. 9, 2004, now Pat. No. Des. 519,038.

(51) Int. Cl.
*A47F 1/04* (2006.01)
*A47F 1/14* (2006.01)

(52) U.S. Cl. ..... 221/310; 221/309; 221/132

(58) Field of Classification Search ..... 221/310, 221/309, 155, 251, 255, 260, 267, 152
See application file for complete search history.

(56) References Cited

U.S. PATENT DOCUMENTS 381,677 A * 4/1888 Culver et al. ..... 221/309
1,215,123 A * 2/1917 Dalton et al. ..... 221/309
2,215,642 A * 9/1940 Gabrielsen ..... 221/125
D123,360 S * 10/1940 Gardner ..... D5/46
2,434,257 A * 1/1948 Burch ..... 221/155
3,450,308 A * 6/1969 Schoenefeld ..... 221/305
3,552,579 A * 1/1971 Simon et al. ..... 211/126.12
D309,224 S * 7/1990 Rabin ..... D6/408
5,642,837 A * 7/1997 Hayes et al. ..... 221/197
6,588,750 B1 * 7/2003 Grauzer et al. ..... 273/149 R
6,637,622 B1 * 10/2003 Robinson ..... 221/268
D490,481 S * 5/2004 Hessing ..... D21/396

OTHER PUBLICATIONS

Merriam-Webster OnLine, "Definition of aperture- Merriam-Webster Online Dictionary," last accessed Jan. 28, 2007, http://www.m-w.com/cgi-bin/dictionary.

* cited by examiner

*Primary Examiner*—Gene O. Crawford
*Assistant Examiner*—Timothy Waggoner
(74) *Attorney, Agent, or Firm*—Carr & Ferrrell LLP

(57) ABSTRACT

A system and method for dispensing pharmaceutical samples is provided. The system comprises a dispenser base, a lid, and a dispensing portion. The dispensing portion further comprises a window, finger cutouts, and a front section of a spring plate. The front section may further comprise curved portions that assist in maintaining a pharmaceutical sample within the pharmaceutical dispenser until a user intentionally removes the pharmaceutical sample. A ramp located substantially adjacent to the spring plate guides the pharmaceutical samples down a loading chamber to the dispensing portion.

20 Claims, 5 Drawing Sheets

SYSTEM AND METHOD FOR DISPENSING PHARMACEUTICAL SAMPLES

CROSS-REFERENCE TO RELATED APPLICATION

The present application is a continuation-in-part application and claims the priority and benefit of U.S. Design Application No. 29/212,993 entitled "Pill Dispenser" filed Sep. 9, 2004 now U.S. Pat. No. D,519,038, which is hereby incorporated by reference.

BACKGROUND OF THE INVENTION

1. Field of the Invention

The present invention relates generally to dispensers, and more particularly, to a system and method for dispensing pharmaceutical samples.

2. Description of Related Art

During a doctor's visit, oftentimes the physician will provide pharmaceuticals or pharmaceutical samples to a patient. In one embodiment, the pharmaceutical samples may be stacked in a gravity stack box or dispenser. Typically, the gravity stack box organizes the samples in a single vertical stack. An opening is provided at the bottom of the gravity stack box that allows the doctor to pull out one or more of the samples. Disadvantageous, the weight of the entire vertical stack will be upon the bottom-most pharmaceutical sample. Thus, it may be difficult to pull out the bottom pharmaceutical sample. Additionally, the amount of pharmaceutical samples which can be stored in the gravity stack box is limited to the height of the gravity stack box which in turn is limited to the vertical space available on top of a counter where the gravity stack box is placed.

Alternatively, the pharmaceutical samples may be stored in a drawer. In this embodiment, the pharmaceutical samples may be loosely stored in the drawer, thus requiring the doctor to reach into the drawer and grab one or more of the samples. While this embodiment allows for easy access to the samples, the samples are not neatly organized. Furthermore, there are typically only a limited number of drawers in an examination room; not enough for dispensing all the various pharmaceutical samples a physician may have in possession.

This disadvantage may lead the physician to store the samples or pharmaceuticals in boxes either in drawers or on top of the counter. Thus, the doctor may dispense pharmaceutical samples by reaching in and grabbing an appropriate amount of samples. The placement of boxes on top of the counter, however, may appear messy and unprofessional.

Therefore there is a need for a system that can neatly and easily organize and dispense pharmaceuticals.

SUMMARY OF THE INVENTION

The present invention provides an exemplary system for dispensing pharmaceutical samples. The system comprises a dispenser base, a lid, and a dispensing portion. The lid may be raised or removed in order to fill the pharmaceutical dispenser with pharmaceutical samples. In exemplary embodiments, the dispenser base may be provided with a recess or molded aperture for storing additional items.

The dispensing portion further comprises a window, finger cutouts, and a front section of a spring plate. In exemplary embodiments, the window is comprised of transparent or translucent material which allows viewing of contents within the pharmaceutical dispenser. An upper finger cutout is formed at a lower, front edge of the window. A similar finger cutout is formed on a lower, front portion of the spring plate and a ramp. These finger cutouts in combination allow a user to reach into the dispensing portion with their fingers in order to access the pharmaceutical sample. The front section of the spring plate may further comprise curved portions that assist in maintaining a pharmaceutical sample within the pharmaceutical dispenser until a user intentionally removes the pharmaceutical sample.

A ramp located substantially adjacent to the spring plate guides the pharmaceutical samples down a loading chamber to the dispensing portion. The ramp is sloped at an angle conducive to allow the pharmaceutical samples to slide down the ramp under gravity.

In exemplary embodiments, the ramp and spring plate are coupled together near a mid-section of the ramp. A portion of the spring plate below the coupling point with the ramp may flex away from the ramp due to the flexible nature of the material comprising the spring plate. The flexing of the spring plate allows the user to remove the pharmaceutical sample by positioning the pharmaceutical sample in a space between the curved portion and the window. The spring plate is prevented from over-flexing by stoppers located of either side of the dispenser base.

The pharmaceutical dispenser may further comprise spacing projections and connector apertures. The spacing projections provide a buffer between the pharmaceutical dispenser and any other vertical objects. The connector apertures provide a coupling point to couple the pharmaceutical dispenser to another pharmaceutical dispenser. In exemplary embodiments, a plurality of pharmaceutical dispensers are coupled together by connectors inserted into the connector apertures.

DESCRIPTION OF EXEMPLARY EMBODIMENTS

Figure 1:
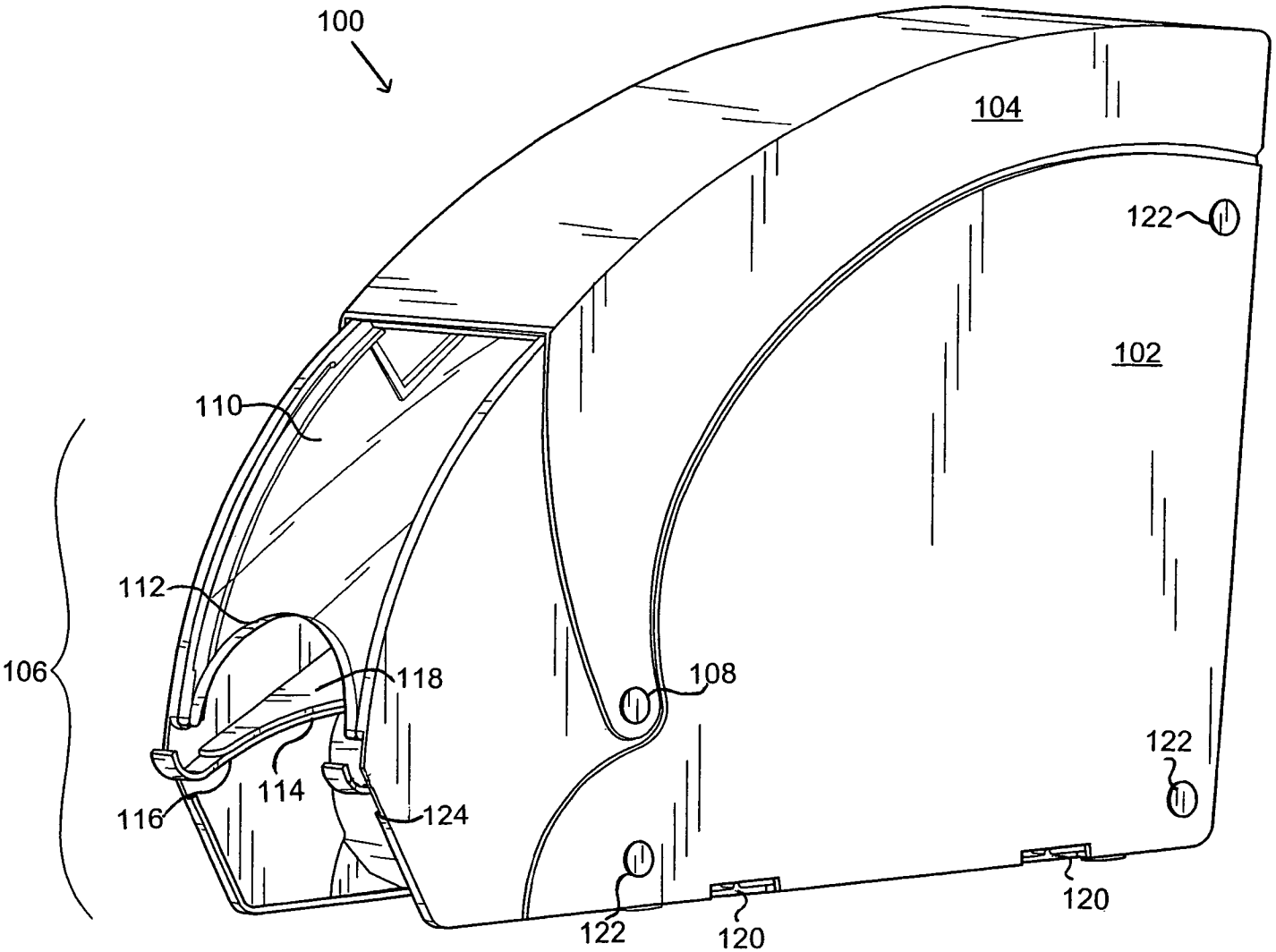
FIG. 1 is a perspective view of a pharmaceutical dispenser according to one embodiment.

The present invention provides a system and method for dispensing pharmaceuticals and pharmaceutical samples in an orderly manner, and is designed to easily dispense the pharmaceuticals one sample at a time. Referring to FIG. 1, a perspective view of a pharmaceutical dispenser 100 is provided. The pharmaceutical dispenser 100 is shown in a dispense configuration. Thus, the pharmaceutical dispenser 100 is ready to dispense samples.

Figure 2:
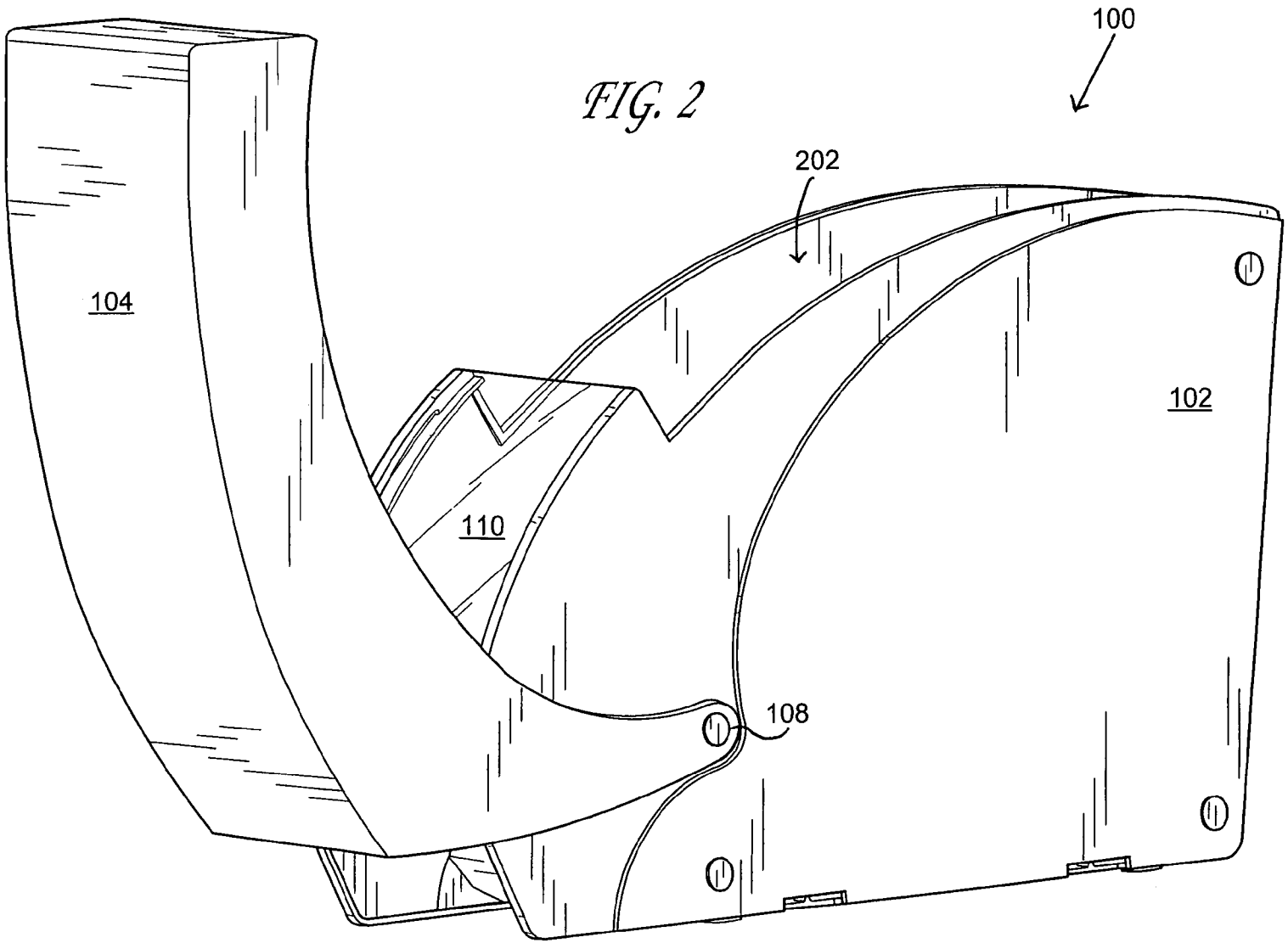
FIG. 2 is a perspective view of the exemplary pharmaceutical dispenser with a lid open for loading of pharmaceuticals.

The exemplary pharmaceutical dispenser 100 comprises a dispenser base 102, a lid 104, and dispensing portion 106. The lid 104 is coupled to the dispenser base 102 via a pivot fastener 108 on either side of the dispenser base 102 and lid 106. By raising the lid 104, as shown in FIG. 2, the lid 104 will pivot at the pivot fastener 108 to provide access to a loading chamber.

Referring back to FIG. 1, the dispensing portion 106 further comprises a window 110, an upper finger cutout 112, a lower finger cutout 114, and a front section of a spring plate 116. The window 110 is typically made of a transparent or translucent material, thus enabling a user to view of the contents of the pharmaceutical dispenser 100 through the window 110. In alternative embodiments, the window 110 may not be transparent or translucent, thereby not providing a view of the contents of the pharmaceutical dispenser 100. In these embodiments, the portion of the pharmaceutical dispenser 100 where the window 110 is located may be manufactured of the same material (e.g., color and composition) as the rest of the pharmaceutical dispenser 100. In yet further embodiments, other portions of the pharmaceutical dispenser 100 may comprise transparent or translucent material to allow interior portions to be viewable.

In the exemplary embodiment, both the lid 104 and the window 110 are curved. In alternative embodiments, the lid 104 and/or the window 110 may not be curved and comprise other surface contours or features. In yet a further embodiment, the lid 104 may not be provided and, instead, the window 110 will extend to a back of the dispenser base 102. An opening or gap may then be provided above a ramp 118 (e.g., in the window 110 or in the dispenser base 102) for loading of pharmaceutical samples.

The upper finger cutout 112 is formed into a lower, front portion of the window 110, while the lower finger cutout 114 is formed into a lower, front portion of the spring plate 116 and the ramp 118. The combination of the finger cutouts 112 and 114 forms an opening that allows a user's fingers to access and pull out at least one pharmaceutical sample from the pharmaceutical dispenser 100. This concept along with the spring plate 116 will be discussed in more detail in connection with FIG. 4*c*.

In exemplary embodiments, the pharmaceutical dispenser 100 is comprised of a plastic material. The various pieces of the pharmaceutical dispenser 100 may be molded separately, and coupled together by various fastening devices or methods such as screws or adhesive. Alternative embodiments may utilize other materials (e.g., metal, composites, etc.) to form the pharmaceutical dispenser 100 pieces. Furthermore, surfaces of the pharmaceutical dispenser 100 may have indicia imprinted or otherwise applied (e.g., stickers) thereon. For example, a name of a company supplying the pharmaceutical sample being dispensed may be provided on one or more surfaces of the pharmaceutical dispenser 100.

In one embodiment, the pharmaceutical dispenser 100 further comprises connector apertures 120. These connector apertures 120 may be positioned on one or both sides of the pharmaceutical dispenser 100. The function of the connector apertures 120 will be discussed in further detail in connection with FIG. 5*a* through FIG. 5*c*. While two connector apertures 120 are shown on a side of the pharmaceutical dispenser 100, the pharmaceutical dispense 100 may comprise any number of connector apertures 120 in any location on the pharmaceutical dispenser 100.

In exemplary embodiments, the pharmaceutical dispenser 100 may also comprise spacing projections 122. These spacing projections 122 extend slightly from the sides of the pharmaceutical dispenser 100. In some embodiments, the spacing projections 122 extend out a same distance as the pivot fastener 108. The spacing projections 122 provide a buffer when a second pharmaceutical dispenser (not shown) is place directly next to the first pharmaceutical dispenser 100. The spacing projections 122 may be located on one or both sides of the pharmaceutical dispenser 100. While only three spacing projections 122 are shown on the side of the pharmaceutical dispenser 100 of FIG. 1, in alternative embodiments, any number of spacing projections 122 may be utilized and can be placed in other locations on the pharmaceutical dispenser 100.

FIG. 2 shows the exemplary pharmaceutical dispenser 100 in a load configuration with the lid 104 in a raised position. As shown, the lid 104 pivots via the pivot fastener 108 located on either side of the pharmaceutical dispenser 100. The lid 104 swings up and over the window 110. In an alternative embodiment, the lid pivot fasteners 108 may not be provided and instead, the lid 104 may be completely removed from the pharmaceutical dispenser 100.

In the load configuration, the pharmaceutical dispenser 100 may be loaded with pharmaceutical samples. The pharmaceutical samples may be placed into a loading chamber 202 which will retain the pharmaceutical samples until the samples are dispensed via the dispensing portion 106. In exemplary embodiments, handfuls of pharmaceutical samples may be placed into the loading chamber 202. Ideally, a width of the pharmaceutical sample, in exemplary embodiments, will be slightly smaller than a width of the pharmaceutical dispenser 100. Due to the design of the loading chamber 202 and the ramp 118, the pharmaceutical samples will automatically position themselves in an orderly manner.

Figure 3:
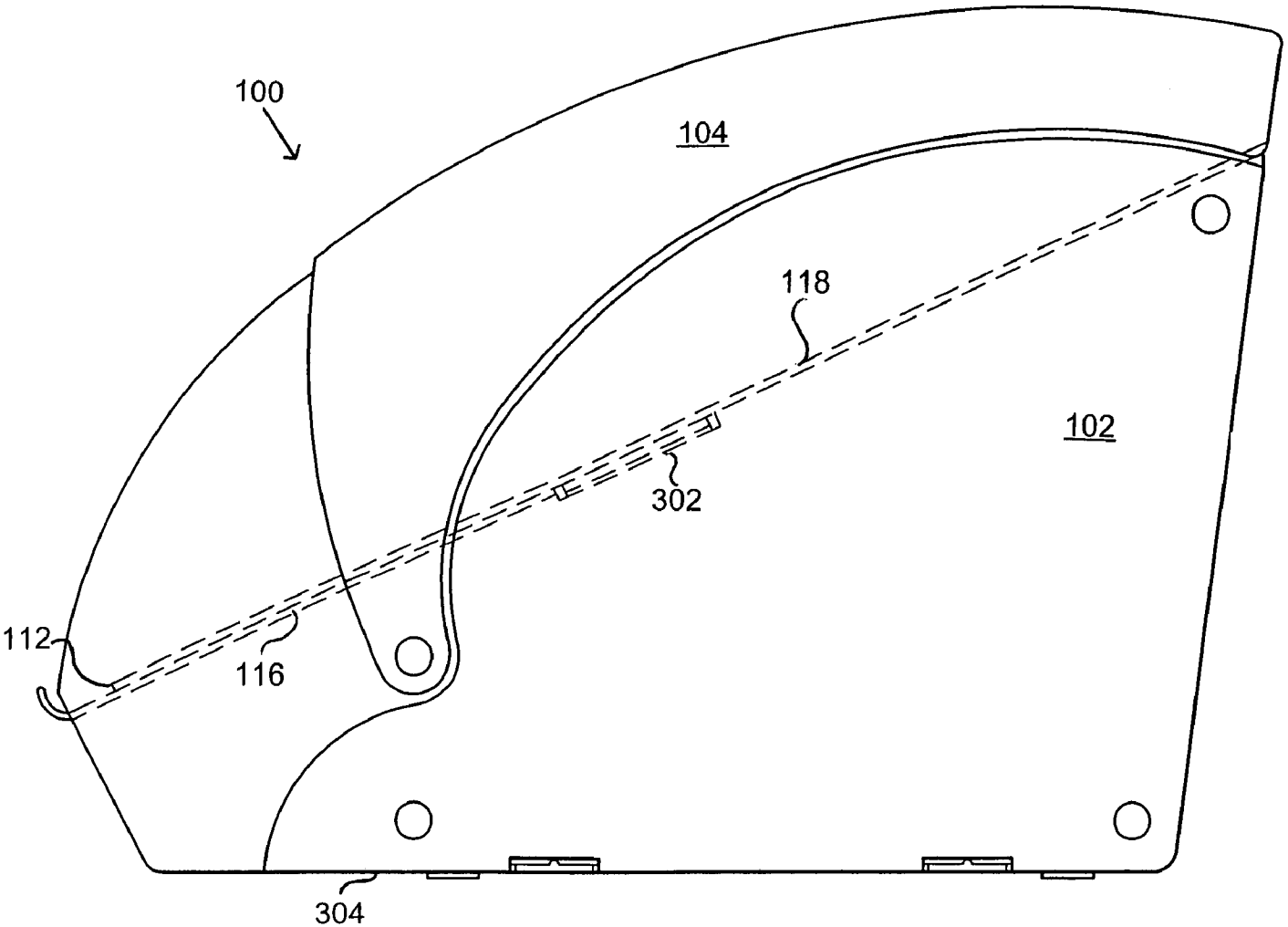
FIG. 3 is a side view of the exemplary pharmaceutical dispenser with internal structures illustrated.

FIG. 3 is a side view of the pharmaceutical dispenser 100 showing internal structures of the spring plate 116 and the ramp 118. As can be seen from this phantom-lined side view, the ramp 118 extends from the cutout 112 to a top of the dispenser base 102. Due to the slope of the ramp 118, pharmaceutical samples loaded into the loading chamber 202 (FIG. 2) will, by force of gravity, slide downward towards the opening of the pharmaceutical dispenser 100. It should be noted that the slope of the ramp 118, in alternative embodiments, may be varied to accommodate the size and structure of the pharmaceutical dispenser 100, and/or may not extend to the top of the dispenser base 102. Additionally, the loading chamber 202 may be made larger or smaller by positioning the ramp lower or higher in the dispensing base 102 or by making the dispensing base 102 taller or shorter in height, respectively.

The exemplary spring plate 116 extends from a mid-section of the ramp 118 to the opening, extending beyond a front of the dispenser base 102. The spring plate 116 is generally attached or coupled to the ramp at a connector section 302. The attachment or coupling may occur via use of adhesive. Alternative embodiments may attach or couple in other manners. While the connector section 302 is located at a mid-section of the ramp 118, alternative embodiments may locate the connect section 302 at other locations along the length of the ramp 118.

Because the spring plate 116 is coupled to the ramp 118 only at the connector section 302, a portion of the spring plate 116 below the connector section 302 is able to flex slightly away from the ramp 118. This flexibility is provided due to the nature of the material used to manufacture the spring plate. For example, the spring plate 116 may be manufactured of a plastic material. In the present embodiment, the spring plate 116 is stopped from further flexing by stoppers 124 (FIG. 1) located of either side of the dispenser base 102. Alternative embodiments may comprise a spring plate 116 which does not flex away from the ramp 118. The functionality of the spring plate 116 will be discussed in further detail in connection with FIG. 4*c*.

The spring plate 116 and the ramp 118 are shown with a lowest portion of both (i.e., at the dispensing portion 106) elevated above a bottom 304 of the dispenser base 102. This elevation provides enough height that a user can easily position their hand above a counter where the pharmaceutical dispenser 100 is located and reach into the dispensing portion 106 to remove a pharmaceutical sample. Alternative embodiments may alter the elevation height of the spring plate 116 and the ramp 118. For example, an embodiment of the pharmaceutical dispenser 100 where the dispensing portion 106 sits flush with an edge of a countertop may comprise a lower elevation.

According to one exemplary embodiment, a portion of the dispenser base 102, below the ramp 118, is empty or hollow. Alternative embodiments, however, may make use of this portion. For example, a recess or molded aperture may be provided on one or both sides of the dispenser base 102 which will provide additional storage space. The additional storage space may be used, for instance, to hold a prescription pad or other items.

Figure 4A:
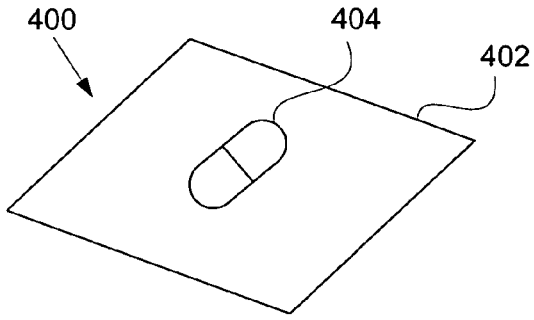
FIGS. 4*a* and 4*b* are various views of an exemplary pharmaceutical sample.
Figure 4B:
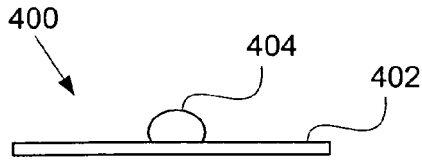

Referring now to FIG. 4*a* and FIG. 4*b*, two views of an exemplary pharmaceutical sample 400 are shown. The exemplary pharmaceutical sample 400 may comprise a packaging 402 having one or more pills or other forms of medication 404 stored within. The packaging 402 and medication 404 may be of various shapes and/or sizes, however, in exemplary embodiments, the width of the packaging 402 is, preferably, slightly smaller than the width of the pharmaceutical dispenser 100. While the embodiment of FIG. 4*a* and FIG. 4*b* shows a particular type of sample packaging 402, alternative embodiments may package the medication 404 in a different manner. For example, the packaging 402 may be a height equivalent to a height of the medication 404.

Figure 4C:
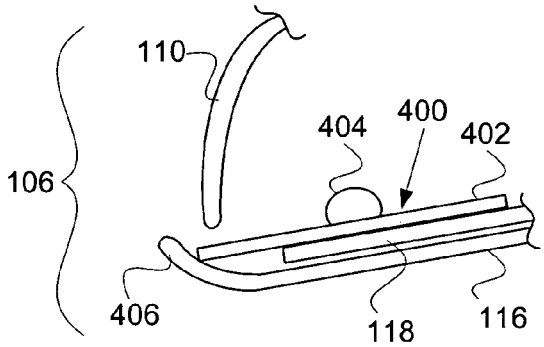
FIG. 4*c* is a close-up, cross-sectional view of a dispensing portion dispensing the exemplary pharmaceutical sample.

FIG. 4*c* is a cross-section, enlarged view of a front section of the dispensing portion 106 with a pharmaceutical sample 400 ready for dispensing. As previously discussed, the pharmaceutical sample 400 will slide down the ramp 118 towards the opening of the dispensing portion 106. A curved portion 406 of the spring plate 116 stops the pharmaceutical sample 400 from sliding all the way out of the dispensing portion 106. The curved portion 406, in exemplary embodiments, is located on either side of the lower finger cutout 114 (FIG. 1) of the spring plate 116.

The curved window 110 may further provide a barrier to the pharmaceutical sample 400 from sliding out of the dispensing portion 106. In one embodiment, the window 110 may contact the pharmaceutical sample 400, and thus provide friction to stop forward movement of the pharmaceutical sample 400. Alternatively, the window 110 may stop the pharmaceutical sample 400 from sliding out by contacting the medication 404 within the pharmaceutical sample 400 when the medication 404 extends upward in the packaging 402 as shown in FIG. 4*b*. The height of the medication 404 will contact and prevent the medication 404 portion of the packaging 402 from moving beyond the window 110.

In order to dispense the pharmaceutical sample 400, the user reaches into the dispensing portion 106 and grasps the pharmaceutical sample 400 through the finger cutouts 112 and 114 (FIG. 1). According to one embodiment, the user may slightly lift a front portion of the pharmaceutical sample 400 and remove the pharmaceutical sample 400 via a space between the window 110 and the spring plate 116. In a further embodiment, the flexibility of the spring plate 116 allows the spring plate 116 to flex slightly downward. This slight flex downward provides a space between the window 110 and the spring plate 116 for the removal of the pharmaceutical sample 400. In either embodiment, the pharmaceutical dispenser 100 presents only one pharmaceutical sample 400 at a time, however, alternative embodiments may be contemplated that provide more than one pharmaceutical sample at a time. For example, the space between the curved portion 406 and the window 110 may be made wider so that more than one pharmaceutical sample may be dispensed at one time.

Figure 5A:
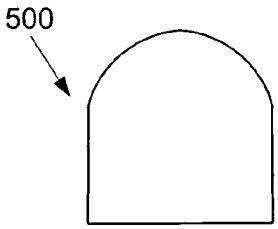
FIGS. 5*a* and 5*b* are various views of an exemplary connector.
Figure 5B:
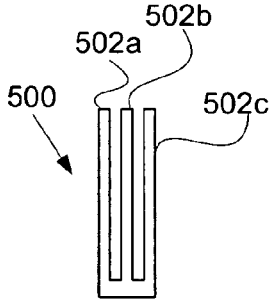
Figure 5C:
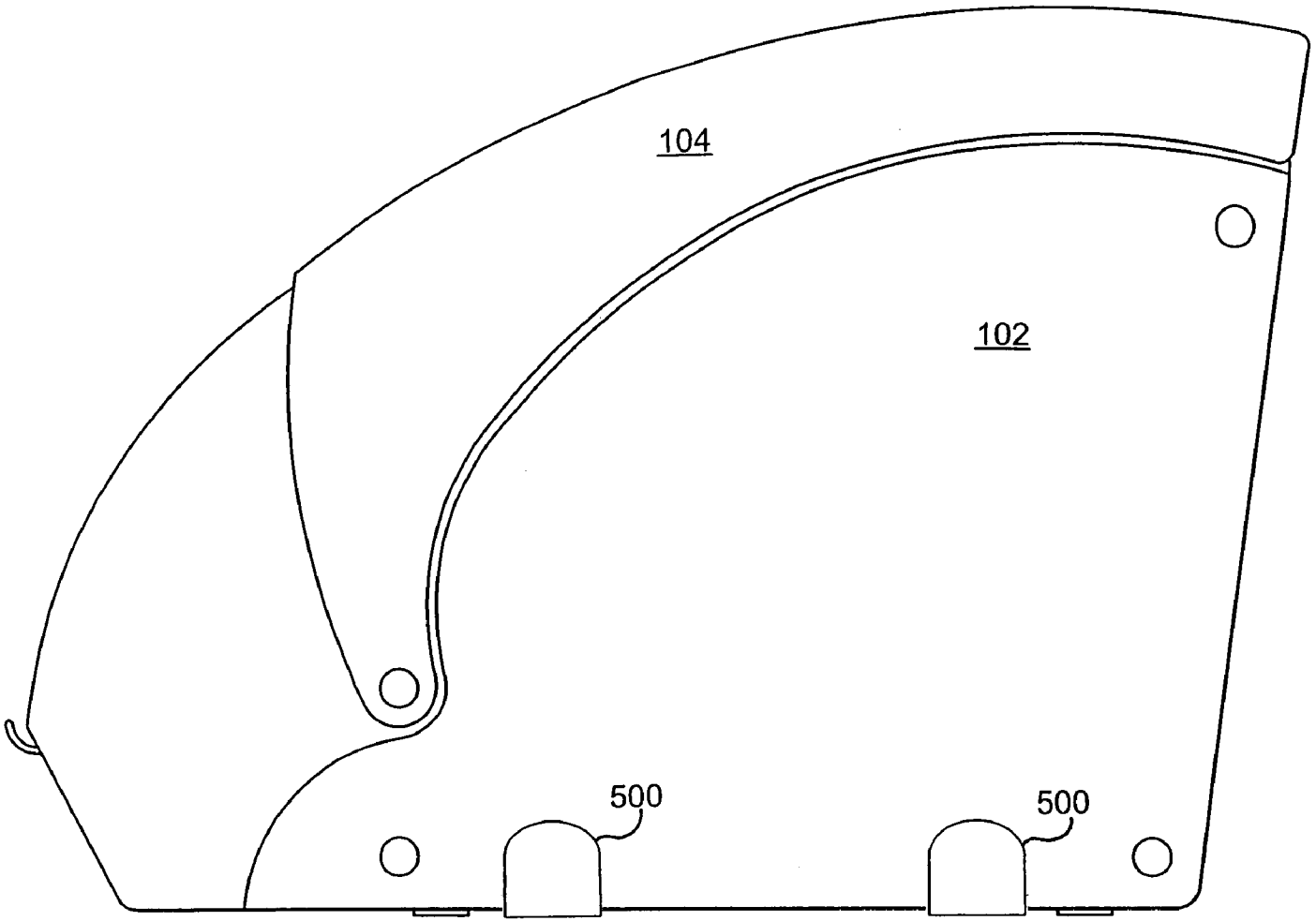
FIG. 5*c* is a side view of a pharmaceutical dispenser having exemplary connectors coupled thereto.

Referring now to FIG. 5*a* and FIG. 5*b*, an exemplary connector 500 is shown in a side view and front view, respectively. The connector 500 comprises a series of extensions 502. A first extension 502*a* of the connector 500 may be inserted into the connector aperture 120 (FIG. 1) as shown in FIG. 5*c*. Because a space between the first extension 502*a* and a second extension 502*b* is smaller than a width of the side of the dispenser base 102, tension from the first and second extensions 502*a* and 502*b* will maintain the connector 500 in position.

A second pharmaceutical dispenser (not shown) may then be coupled to the first pharmaceutical dispenser 100. Ideally, a third extension 502*c* will be inserted into a corresponding connector aperture in the second pharmaceutical dispenser. The tension between the second and third extensions 502*b* and 502*c* will maintain the connector in position with the second pharmaceutical dispenser. As a result, the first pharmaceutical dispenser 100 and the second pharmaceutical dispenser are now coupled together.

Further pharmaceutical dispensers may be coupled to the first pharmaceutical dispenser 100 and/or second pharmaceutical dispenser. Thus, a row of pharmaceutical dispensers may be coupled together. This provides a neat and organized system of pharmaceutical dispensers which may be placed on a countertop, and which can dispense a large number of different pharmaceutical samples. Additionally, with the use of the ramp 118 and loading chamber 202, the height of the pharmaceutical dispenser 100 is lower than that required to dispense a same amount of pharmaceutical samples as in a gravity stack dispenser.

The present invention is described above with reference to exemplary embodiments. It will be apparent to those skilled in the art that various modifications may be made and other embodiments can be used without departing from the broader scope of the present invention. For example, the pharmaceutical dispenser 100 may be utilized to dispenser non-pharmaceutical items. Therefore, these and other variations upon the exemplary embodiments are intended to be covered by the present invention.

What is claimed is:

1. A system for dispensing samples, comprising:

a dispenser base;

a dispensing portion coupled to the dispenser base and configured to allow a user access to the samples;

a ramp coupled to the dispensing portion within the dispenser base and configured to guide the samples to the dispensing portion;

a spring plate coupled to the ramp, wherein the spring plate may flex away from the ramp; and at least one stopper to prevent the spring plate from over-flexing.

2. The system of claim 1 further comprising a lid coupled to the dispenser base and configured to cover the samples stored in the dispenser base.

3. The system of claim 1 wherein the dispenser base further comprises a recess configured for storing additional items.

4. The system of claim 1 wherein the dispenser base further comprises at least one connector aperture.

5. The system of claim 4 further comprising a connector configured for insertion into the at least one connector aperture.

6. The system of claim 1 wherein the dispenser base further comprises spacing projections.

7. The system of claim 1 wherein the dispensing portion further comprises a window.

8. The system of claim 1 wherein the dispensing portion further comprises at least one finger cutout configured to allow the user access to the sample in the dispensing portion.

9. The system of claim 8 wherein the finger cutout is formed in a lower, front portion of a window.

10. The system of claim 1 wherein a finger cutout is formed in a lower, front portion of the ramp.

11. The system of claim 1 wherein a finger cutout is formed in a lower, front portion of the spring plate.

12. The system of claim 1 wherein the spring plate further comprises at least one curved portion configured to prevent the samples from unintentionally dispensing.

13. A system for dispensing samples, comprising:

means for angularly guiding the samples towards a dispensing portion of the dispenser;

means for retaining the samples at an opening of the dispensing portion;

a stopper means for stopping an angularly guiding component located at the opening of the dispensing portion from over-flexing; and means for allowing a user to physically enter the dispensing portion to access the samples.

14. The system of claim 13 further comprising means for viewing content of the dispenser.

15. The system of claim 13 further comprising means for coupling the dispenser to one or more further dispensers.

16. The system of claim 13 further comprising means for buffering a side of the dispenser.

17. The system of claim 13 further comprising means for storing samples within the dispenser.

18. A method for dispensing samples, comprising:

angularly guiding samples stored in a dispenser to a dispensing portion of the dispenser;

retaining the samples at an opening of the dispensing portion to prevent unintentional dispensing of the samples;

stopping a spring plate located at the opening of the dispensing portion from over-flexing utilizing at least one stopper; and allowing a user to physically enter the dispensing portion to access the samples.

19. The system of claim 1 further comprising positioning the spring plate and ramp with a lowest portion elevated above a bottom of the dispenser base to allow a user to position their hand above a lateral surface on which the dispenser is positioned when dispensing the samples.

20. The method of claim 18 wherein retaining the samples comprises utilizing at least one curved portion of the spring plate.

* * * * *